United States Patent [19]

Salomon

[11] 4,383,702

[45] May 17, 1983

[54] SAFETY BINDING FOR A SKI

[75] Inventor: George P. J. Salomon, Annecy, France

[73] Assignee: S.A. Etablissements Francois Salomon & Fils, Annecy, France

[21] Appl. No.: 210,388

[22] Filed: Nov. 17, 1980

Related U.S. Application Data

[63] Continuation of Ser. No. 863,146, Dec. 21, 1977, abandoned.

[30] Foreign Application Priority Data

Dec. 21, 1979 [FR] France ..... 76 38470

[51] Int. Cl.[3] ..... A63C 9/08

[52] U.S. Cl. ..... 280/611; 280/613

[58] Field of Search ..... 280/612, 611, 613, 617, 280/601, 602, 607

[56] References Cited

U.S. PATENT DOCUMENTS

| | | | |
|---|---|---|---|
| 2,950,118 | 8/1960 | Sharpe | 280/611 X |
| 3,260,532 | 7/1966 | Heuvel | 280/602 |
| 3,907,316 | 9/1975 | Marker et al. | 280/612 |
| 3,917,300 | 11/1975 | Salomon | 280/611 |
| 4,130,296 | 12/1978 | D'Antonio et al. | 280/612 |
| 4,291,894 | 9/1981 | D'Antonio et al. | 280/612 |

FOREIGN PATENT DOCUMENTS

| | | | |
|---|---|---|---|
| 2519544 | 11/1975 | Fed. Rep. of Germany | 280/612 |

*Primary Examiner*—David M. Mitchell
*Assistant Examiner*—Milton L. Smith
*Attorney, Agent, or Firm*—Sandler & Greenblum

[57] ABSTRACT

A safety binding for a ski the disengagement of which for the release of a skier's boot is controlled by a signal provided by an electrical circuit. The safety binding has a stress detection device located on or in a test member which serves as a connection member between the boot and ski.

4 Claims, 16 Drawing Figures

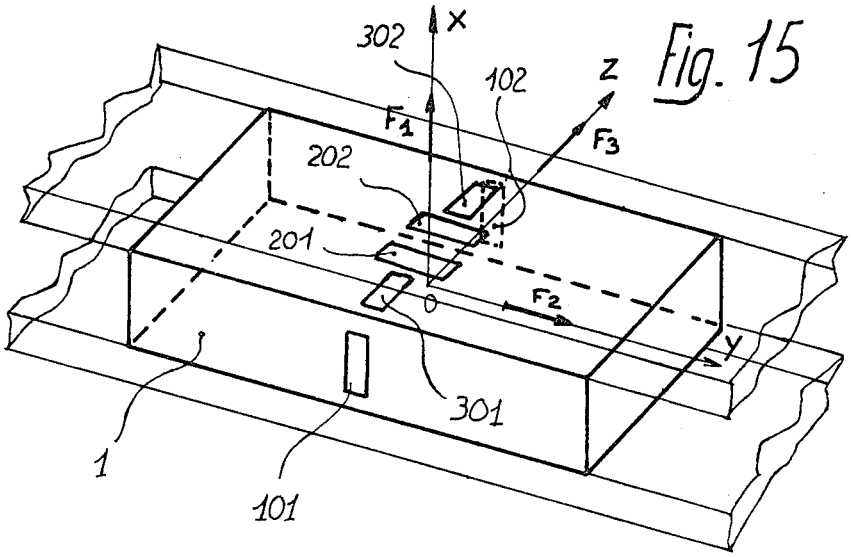
Fig. 15
Fig. 16
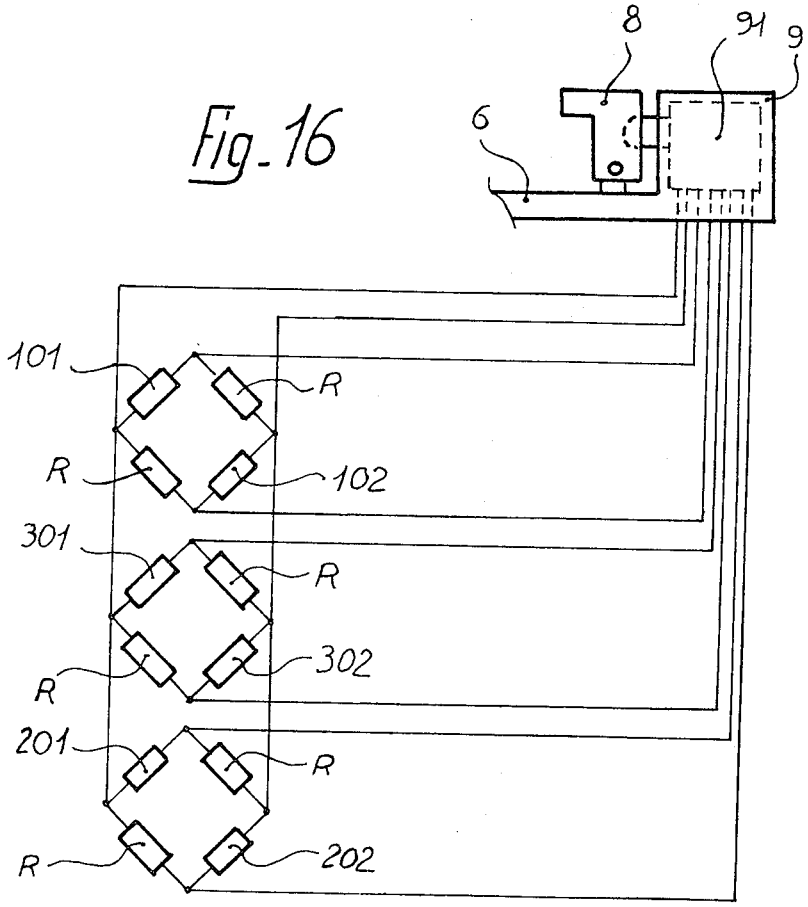

SAFETY BINDING FOR A SKI

This is a continuation of application Ser. No. 863,146 filed Dec. 21, 1977, now abandoned.

BACKGROUND OF THE INVENTION

The present invention relates to a safety binding for a ski, tripping of which for the release of the boot is controlled by a signal coming from an electrical circuit and relates more particularly to means for detecting the stress produced at the time of skiing.

Safety bindings for skis are known which comprise at least one detection circuit followed by a calculation circuit, then a tripping circuit, these three circuits being supplied by a supply circuit. In this type of binding, the detection circuit detects the stresses due to skiing and is generally in the form of a bridge of gauges. This detection circuit produces a signal dependent on the stress occurring at the time of skiing, which signal is processed by the calculation circuit, which may be a filter for example. This calculation circuit thus emits a signal which is compared with a predetermined value in a threshold circuit which, if this threshold is exceeded, sends a tripping order to the tripping circuit which facilitates the release of a locking member and thus the release of the ski boot. In order to take into account lateral and vertical stresses, it has already been envisaged to use two complete circuits each with their own threshold and each tripped independently, these two circuits being different since the stresses to be measured in the two directions are not identical. Another embodiment proposed a detection circuit, calculation circuit and threshold for the vertical, these two circuits being connected to an OR-gate connected to a single tripping circuit.

Nevertheless, this type of construction has certain drawbacks, since the circuits are different and are produced with different components, which involves high manufacturing costs and numerous risks of errors in the assembly. In addition to the electrical disengagement, there is a mechanical disengagement and the mechanical parts are numerous, which naturally causes high manufacturing costs and clearances or friction may cause errors. Therefore, these systems are not reliable.

SUMMARY OF THE INVENTION

The present invention makes it possible to resolve all these drawbacks by proposing a device for detecting stress making it possible to use identical circuits for the two directions of stress and to use another identical circuit for measuring another stress, in particular transverse stress. This is particularly advantageous especially for mass production, since the cost price for the purchase of material and assembly are thus reduced. In addition, in the present invention, the detection circuits are located on a test member for carrying out disengagement directly, without intermediate members, which is normally carried out mechanically. Further, it is also particularly advantageous to be able to provide a test member for detection, since one could choose the shape of this member depending on hypotheses which could be put forward or the possible results of studies undertaken in the field of the strength of bones, in particular as regards dynamic stress.

It should also be noted that the device according to the invention makes it possible to measure the moments to which the leg is subjected or the forces to which the latter is subjected, or even, both at the same time.

To this end, this safety binding for a ski, comprising an electrical device for detecting stress to which the leg is subjected in at least two directions, is characterised by the fact that the detection device is located on a test member serving on its own as a connecting member between the boot and ski.

The test member is advantageously located underneath the skier's foot and preferably along the axis of the tibia.

The shape of the test member and the arrangement of the detection gauges are such that the signals transmitted by the various bridges are equal and this is for the maximum stresses.

Various embodiments of the present invention will be described hereafter, as non-limiting examples, with reference to the accompanying drawings in which:

In the drawings:

FIG. 15 is a perspective view of a test member comprising gauges located and connected in order to detect forces along three perpendicular axes.

FIG. 16 is an electrical circuit diagram showing the connection of the gauges of the test member of FIG. 15, in the various measuring bridges.

DESCRIPTION OF THE INVENTION

Figure 1:
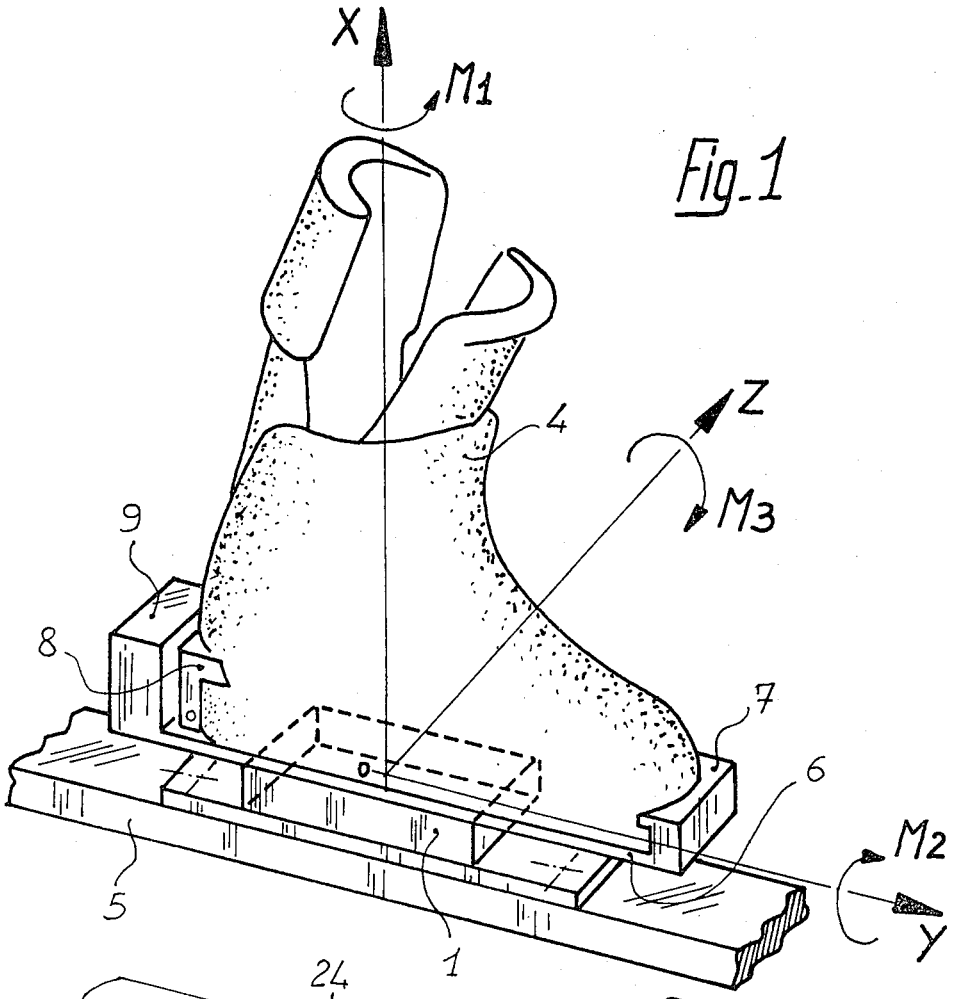
FIG. 1 is a perspective view of one embodiment of a safety binding according to the invention.

FIG. 1 is a perspective view of a ski boot 4 mounted on a ski 5. More particularly, the boot 4 is mounted on a plate 6 which rests on the ski 5 through the intermediary of a test member designated generally by the reference 1. The ski boot 4 is mounted on the plate 6 by a front retaining member 7 and a rear retaining member 8 so that it can be disengaged. In the non-limiting example shown in the drawing, it is the rear retaining member 8 which can be disengaged to ensure the release of the boot. To this end, this rear retaining member is held by a locking member which is itself controlled by an electrical circuit housed at least partly in the rear casing 9 of the binding. When an inadmissible stress is exerted on the skier's leg, this circuit emits an electrical signal which causes disengagement of the rear retaining member 8 and consequently releases the boot.

Figure 2:
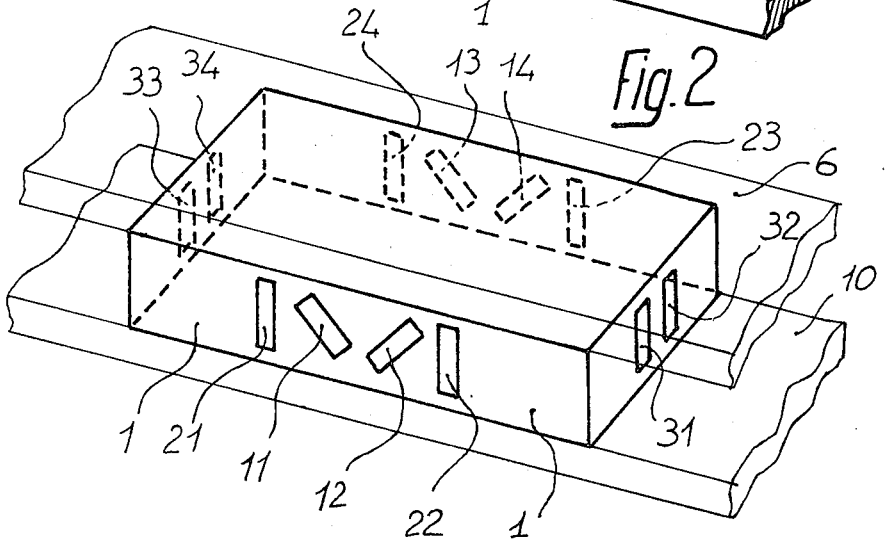
FIG. 2 is a perspective view of a particular embodiment of the test member with an example of the arrangement of the gauges for detecting stress, the test member being drawn in full line and the remainder of the support in thin line.

Detection of the stress to which the skier's leg is subjected, is effected by means of detection circuits housed in the test member 1. This test member 1 is shown in FIGS. 1 and 2, as having the shape of a parallelepiped but this shape is given solely as an example and the test member could have any other shape, as will be seen hereafter.

The circuits for detecting stress are constituted for example by bridges of gauges measuring the moments to which the skier's leg is subjected when skiing, along three axes, namely:

the moment $M_1$ about the vertical axis O X for lateral, so-called twisting stresses;

the moment $M_2$ about the horizontal and longitudinal axis O Y for transverse stresses;

the moment $M_3$ about the horizontal and transverse axis O Z for vertical, so-called bending stresses.

The three bridges of gauges respectively measuring these moments are located on the test member 1 in order to record the maximum extensions.

Thus, as can be seen in FIG. 2, the twisting moment $M_1$ is detected by a first bridge of gauges constituted by four gauges 11, 12, 13, 14. These gauges are preferably arranged at 45° with respect to the vertical and transverse plane X O Z defined by the axes OX and OZ. The gauge 11 is symmetrical to the gauge 12 with respect to the plane X O Z and the same is true for the gauges 13 and 14. In addition, the gauges 11 and 13 are arranged symmetrically with respect to the vertical and longitudinal plane X O Y defined by the axes OX and OY and the same is true for the two other gauges 12 and 14.

The transverse bending moment $M_2$ is detected by a second bridge of gauges constituted by four gauges 21, 22, 23, 24 arranged parallel to the vertical axis OX. The gauge 21 is symmetrical to the gauge 22 with respect to the plane XOZ and the same is true for the two other gauges 23, 24. In addition, the two gauges 21, 24 are also symmetrical to each other with respect to the plane XOY and the same is true for the two other gauges 22, 23.

The bending moment $M_3$ is detected by a third bridge of gauges constituted by four gauges 31, 32, 33, 34 extending parallel to the vertical axis OX. The gauge 31 is symmetrical to the gauge 32 with respect to the plane XOY and the same is true for the two other gauges 33 and 34. In addition, the gauges 31 and 33 are symmetrical with respect to the plane XOZ, in the same way as the two other gauges 32 and 34.

The method of connection of the gauges for the three measuring bridges is identical. Each of the gauges detects the entire variation in length (extension or contraction) peculiar to the particular measurement. Thus, the first bridge of gauges 11 to 14, which measures the twisting moment $M_1$, emits a signal which is proportional to $4e_1$, $e_1$ being the variation in length of each of the gauges when the skier's leg is subjected to a twisting moment $M_1$. In the same manner, the two other bridges of gauges 21 to 24 detecting the transverse bending moment $M_2$ and 31 to 34 detecting the bending moment $M_3$ respectively emit signals proportional to $4e_2$ and $4e_3$, $e_2$ and $e_3$ being the variations in length of the respective gauges when the skier's leg is subjected to a transverse bending moment $M_2$ and a bending moment $M_3$.

Figure 3:
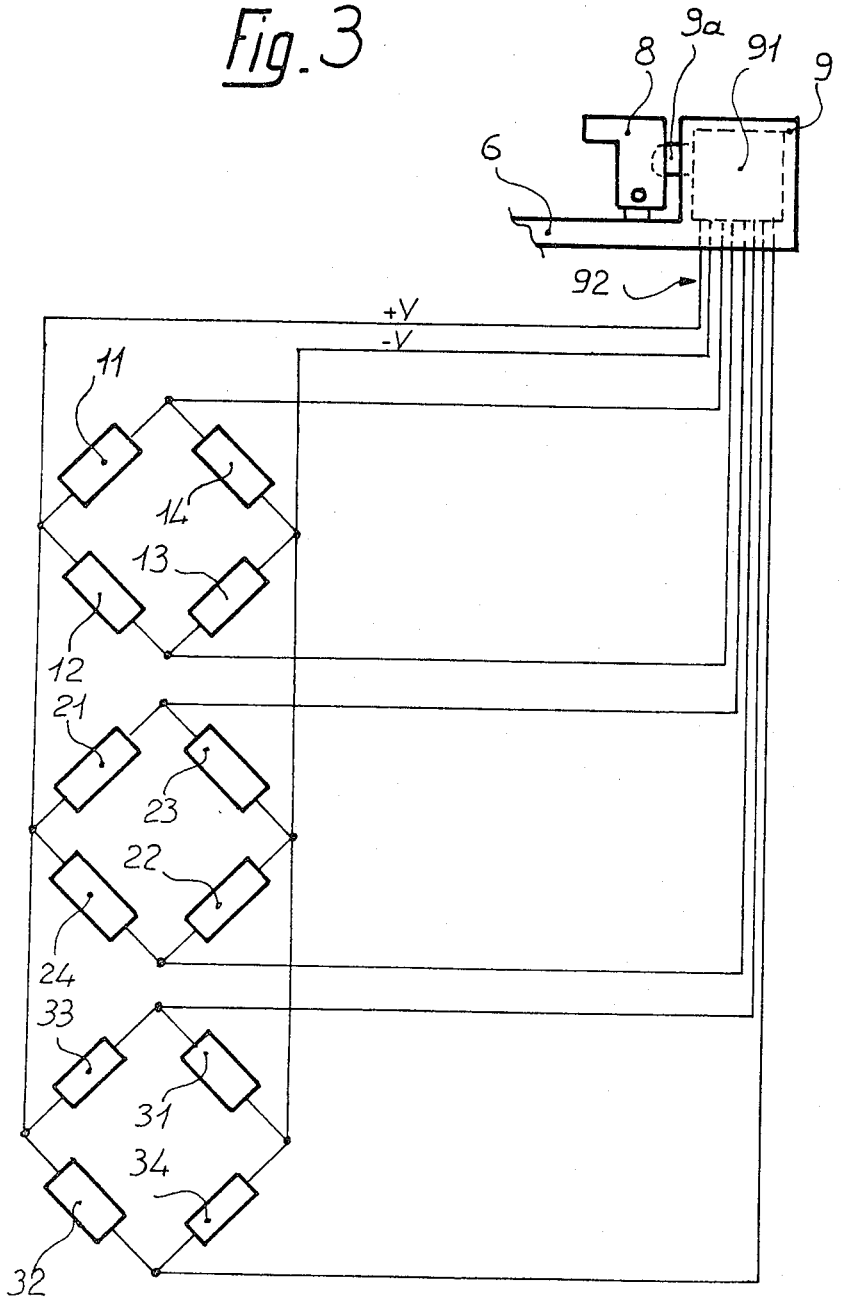
FIG. 3 is an electrical circuit diagram of the connection used for the bridges of gauges.

FIG. 3 is an electrical circuit diagram showing how the various gauges are connected. The casing 9 which is located at the rear of the plate 6 comprises a tripping circuit controlling a locking member 9a acting on the rear retaining member 8. The casing 9 also contains electrical circuits 91 comprising a +V and −V supply for the bridges of gauges, as well as for the calculation, threshold and tripping circuits. A bundle of leads 92 ensures the connection between the bridges of gauges detecting the stresses and the remainder of the circuits.

With such an arrangement of gauges on the test member, as well as their connection, one thus produces electrical disengagement since a twisting moment will cause only the bridge of gauges 11, 12, 13, 14 to react, a forwards bending moment will put only the bridge of gauges 31, 32, 33, 34 out of balance and a transverse bending moment will put only the bridge of gauges 21, 22, 23, 24 out of balance.

Figure 4:
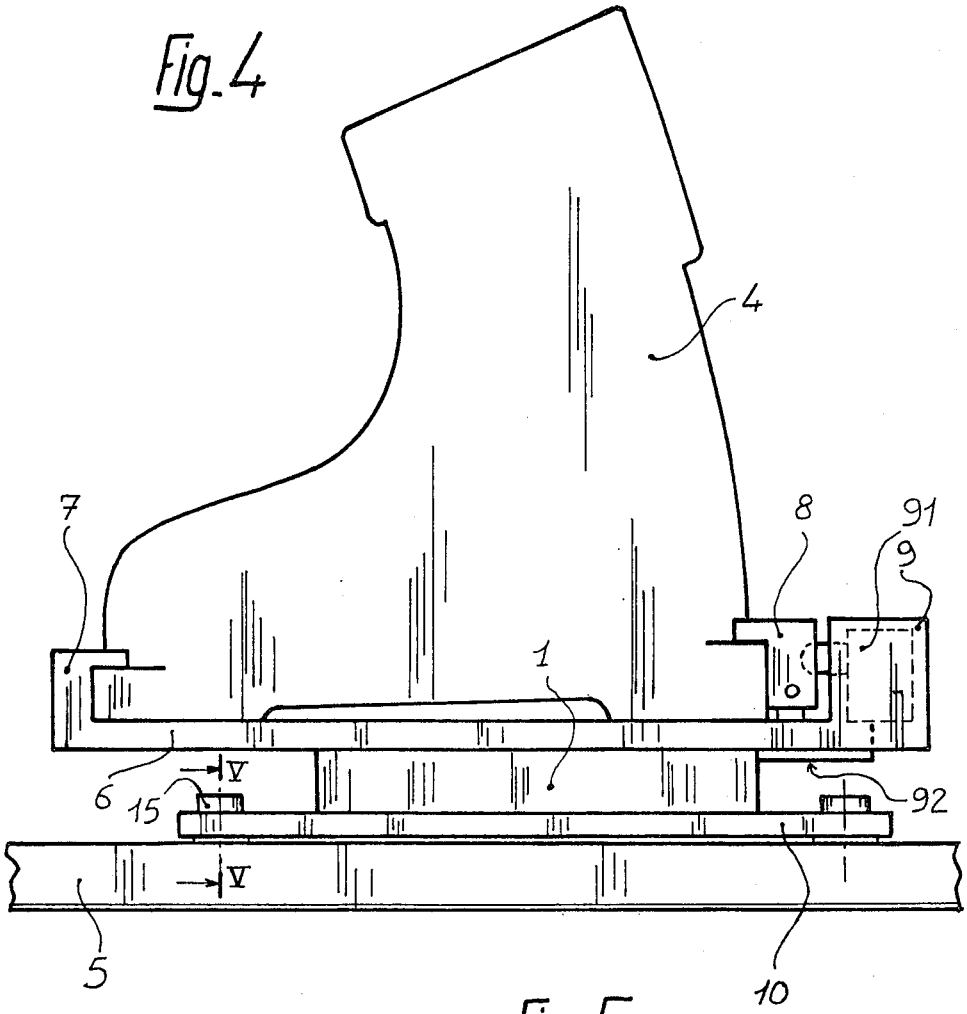
FIG. 4 is an elevational view of one embodiment of a safety binding according to the invention.
Figure 5:
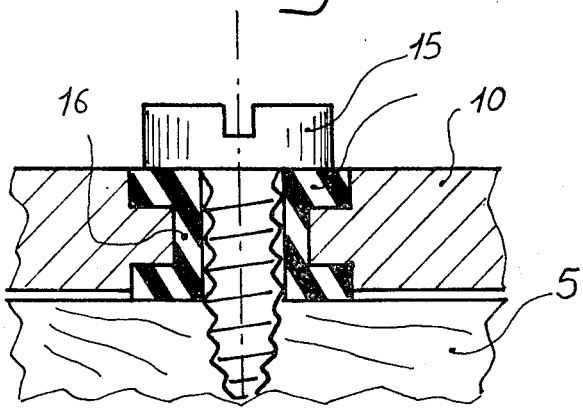
FIG. 5 is a partial vertical and transverse sectional view, to an enlarged scale, on line V—V of FIG. 4.

FIG. 4 shows in a more detailed manner how the connection between the ski boot 4 and the ski 5 is ensured. The connecting device is composed of two longitudinal plates 6 and 10 interconnected by the test member 1. The ski boot 4 which is retained by the front and rear members 7 and 8 respectively is fixed to the upper plate. The lower support plate 10 is fixed to the ski, for example by means of four screws 15. According to a particularly advantageous arrangement shown in FIG. 5, the lower support plate 10 is fixed to the ski 5 by means of shock absorber blocks 16 inserted in the plate. Screws 15 pass through these blocks 16 and this arrangement makes it possible to attenuate slight stresses which are not dangerous for the leg, without the electrical circuits intervening.

The test member 1, in which the detection bridges are located, is preferably an integral part of the upper plate 6 as well as of the lower support plate 10.

Figure 6:
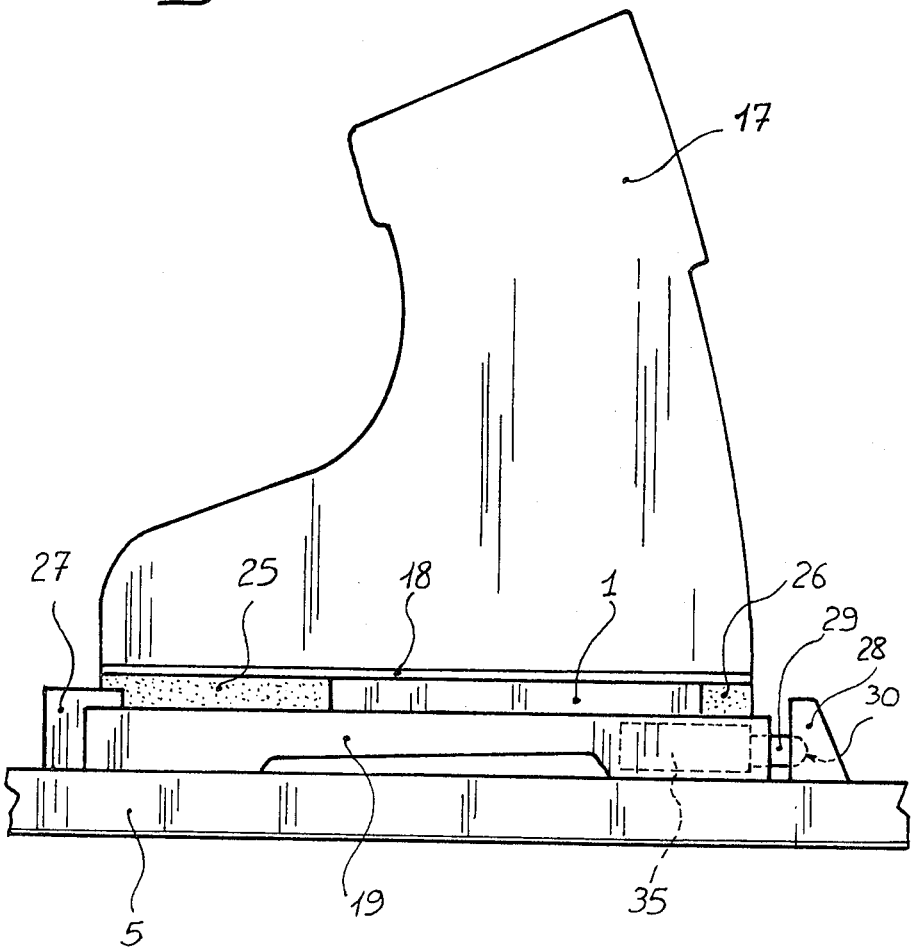
FIG. 6 is an elevational view of a variation of a safety binding according to the invention.

In the variation shown in FIG. 6, the test member 1 is associated with an arrangement of the boot/binding type. In its lower part, the boot 17 shown in FIG. 6 comprises a plate 18 with which the test member 1 is integral. Extending below the latter is a longitudinal plate 19 forming a sole with which the test member 1 is also integral. The empty spaces defined between the upper plate 18 and the lower sole plate 19 by the test member 1 forming a spacer member, are occupied by deformable filling members, for example made of rubber, namely a front member 25 and rear member 26. The boot 17 which is connected to the sole plate 19 by means of the test member 1, is retained on the ski 5 by a front retaining member 27 integral with the ski and releasable rear retaining means for ensuring the release of the boot. These rear retaining means are constituted essentially by a fixed retaining member 28, integral with the ski and a releasable locking member 29 mounted to move in the rear part of the sole plate 19 of the boot 17. This locking member engages in a housing 30 of the stationary retaining member 28. Housed in the sole plate 19 is a casing 35 comprising the calculation circuit and tripping circuit acting on the movable locking member 29.

As in the case of the preceding embodiment, the detection circuits, constituted by the bridges of gauges for example, are located on the test member 1 and the connections are identical to those illustrated in FIG. 3.

Since the three bridges of gauges are arranged on the same test member 1, electrical disengagement is thus achieved in a fairly simple manner.

Preferred shapes of the horizontal section of this block which can be adopted according to the parameters chosen for the conditions of use, will now be described in more detail.

The problem is to satisfy the dynamic conditions. It is known that for slow stresses, the skier's leg withstands the moments $M_1s$, $M_2s$ and $M_3s$ and that for rapid stresses, therefore in the field of dynamics, the leg withstands much greater twisting and bending moments $M_1$ max, $M_2$ max, $M_3$ max. It is possible to determine the shape of the horizontal section of the test member as a function of the relationship which it is desired to obtain between these admissible maximum moments. It should be noted that in order to obtain a satisfactory operation of the tripping circuit, the amplitudes of the electrical signals emitted by the three bridges of gauges, when the latter detect maximum stresses, must be equal. In other words, the signals proportional to $4e_1$ ($e_1$ being the extension to which each of the gauges of the first bridge of gauges 11–14 is subjected when the moment $M_1$ reaches the maximum admissible value $M_1$ max) to $4e_2$ ($e_2$ being a similar extension in the case of the second bridge of gauges 21–24 for the maximum extension $M_2$ max) and to $4e_3$ ($e_3$ being the similar extension for the third bridge of gauges 31–34) should have the same values at the input of the calculation and tripping circuit.

Figure 7:
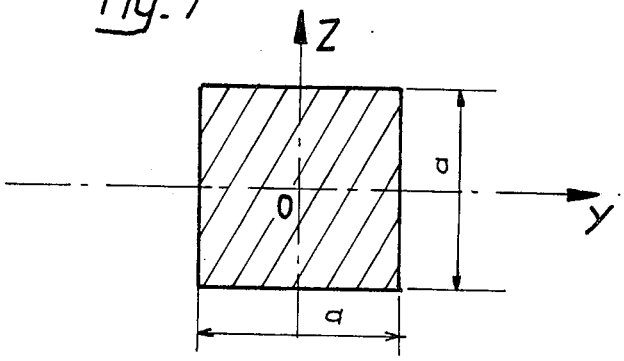
FIGS. 7, 8, 9, 10 are horizontal sectional views, i.e. along the plane Z O Y, of various preferred embodiments of the test member of the safety binding.
Figure 8:
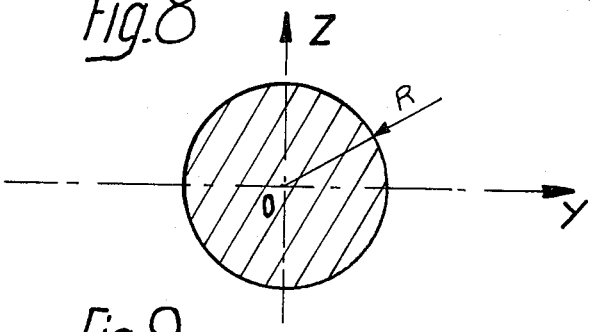

Calculations show that if one wishes to obtain the relationship $M_1 \max = M_2 \max = M_3 \max$, the test member 1 should have a square section, with sides a, as shown in FIG. 7. On the other hand, if one wishes to have the relationship $M_1 \max = 1.5\ M_2 \max = 1.5\ M_3 \max$ calculations show that the test member should have a circular section of radius R, as shown in FIG. 8.

Figure 9:
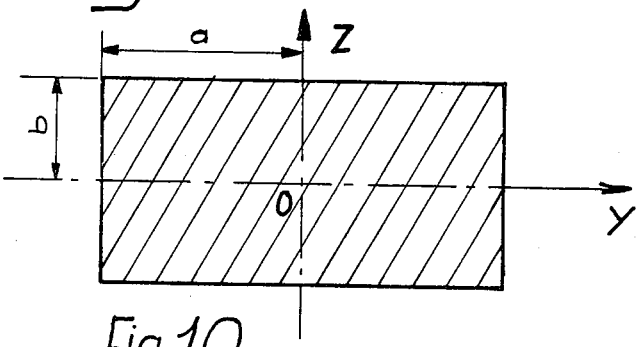

If one wishes to obtain the relationship $M_1 \max = M_2 \max = 0.5\ M_3 \max$, the test member 1 should have a rectangular section with sides 2*a* and 2*b*, with a=2*b*, as illustrated in FIG. 9.

Figure 10:
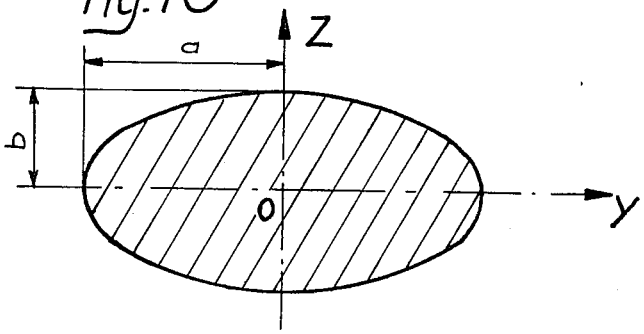

If one wishes to have a relationship $M_1 \max = 0.8\ M_2 \max = 0.4\ M_3 \max$, the test member 1 should have a straight elliptical section (FIG. 10) with a=2*b*, a and b being respectively the halves on the minor axis and major axis of the ellipse.

The arrangement of the gauges on the connecting block which was described previously, is a particularly advantageous arrangement, but one could equally well provide a different arrangement of these gauges, in particular as regards the inclination of the gauges 11–14 of the first bridge, without diverging from the framework of the invention.

Figure 11:
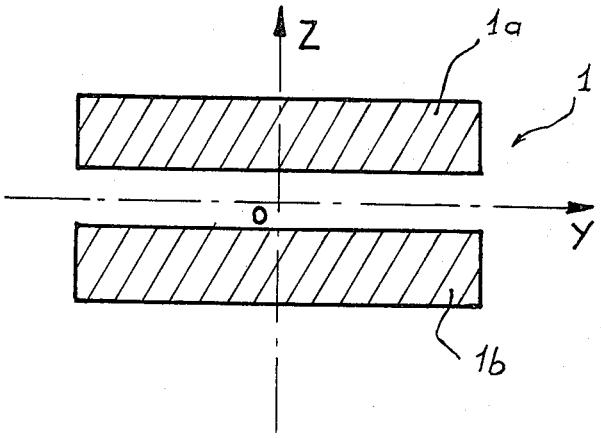
FIG. 11 is a horizontal sectional view of a test member in two parallel parallelepipedal parts.
Figure 12:
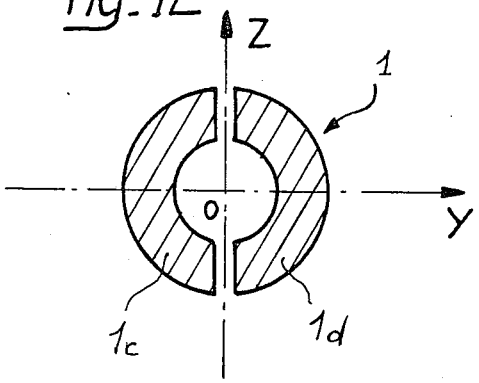
FIG. 12 is a horizontal sectional view of a test member in two parts each constituted by a segment of a ring.

FIGS. 11 and 12 are views in diagrammatic horizontal section, i.e. through the plane YOZ, of variations of the test member 1.

In the case shown in FIG. 11, the test member 1 is constituted by two identical parts 1*a*, 1*b*, each forming a parallelepipedal block extending longitudinally and symmetrical with respect to the vertical and longitudinal plane XOY.

In the case shown in FIG. 12, the test member 1 is formed of two halves 1*c*, 1*d*, each constituted by a section of a ring. The two halves 1*c*, 1*d* are arranged symmetrically with respect to the vertical and transverse plane XOZ.

Figure 13:
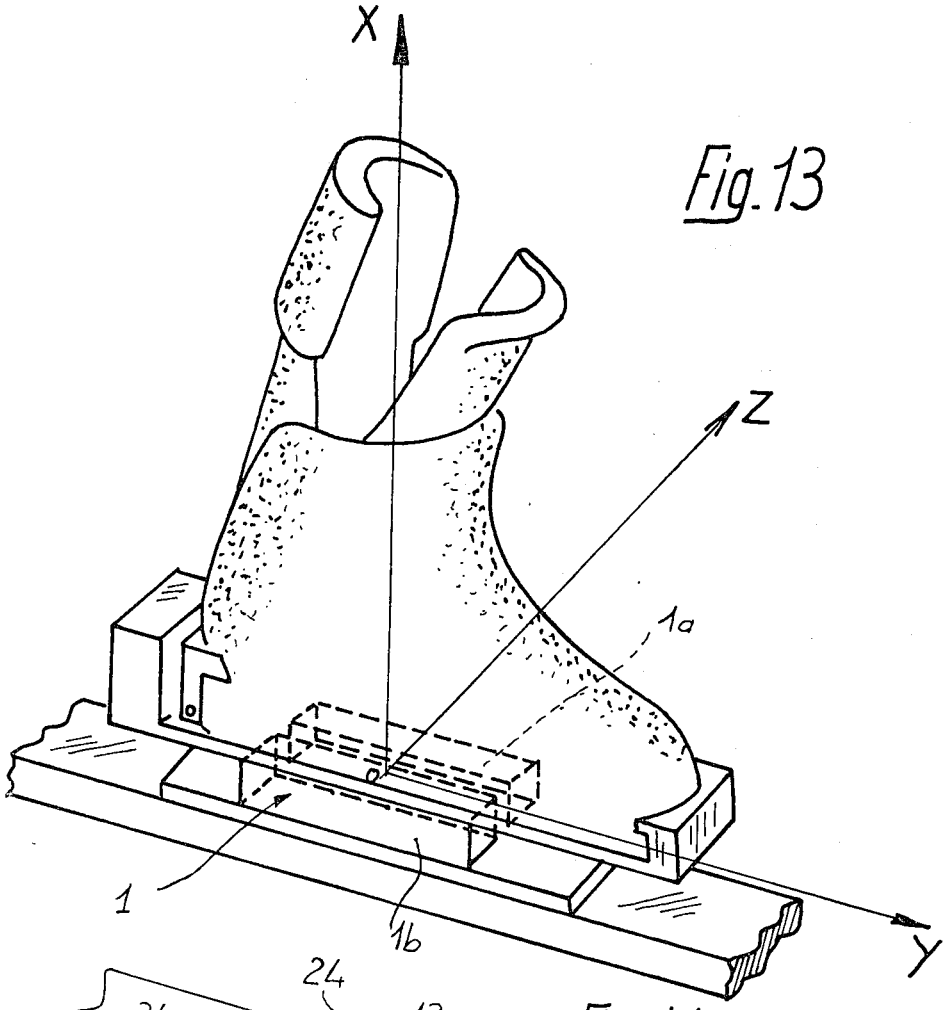
FIG. 13 is a perspective view of a safety binding comprising a test member similar to that illustrated in FIG. 11.
Figure 14:
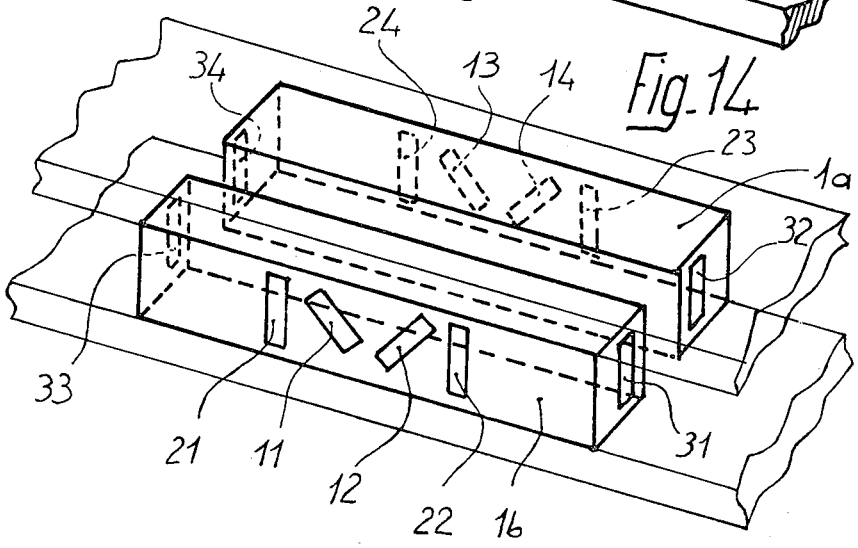
FIG. 14 is a perspective view, to an enlarged scale, of a test member similar to that of FIG. 11.

The test member 1, constituted by two parallelepipedal halves 1*a*, 1*b* as shown diagrammatically in FIG. 11, is illustrated in its practical use in FIGS. 13 and 14. Each of the halves 1*a*, 1*b* of the test member 1 comprises half the gauges of the measuring bridges, i.e. the half 1*a* comprises the gauges 13, 14, 23, 24, 32, 34 whereas the other half $1_b$ comprises the gauges 11, 12, 21, 22, 31 and 33.

In the preceding embodiments, the test member 1 comprises gauges mounted in order to detect the moments $M_1$, $M_2$ and $M_3$ to which the skier's leg may be subjected. However, it is possible to devise another device in which the gauges detect the forces along the three directions OX, OY and OZ, as shown in FIGS. 15 and 16.

In this embodiment, the test member 1 comprises on its sides, the respective gauges 101, 102 extending parallel to the vertical axis OX and detecting the vertical forces $F_1$. These two gauges are arranged at the level of the plane XOZ.

On its upper side, the test member 1 also comprises two other gauges 201, 202 extending horizontally, parallel to the axis OY and symmetrically with respect to the plane XOY. These two gauges 201 and 202 detect longitudinal forces $F_2$.

Finally, also on its upper side, the test member 1 comprises respective gauges 301, 302 extending parallel to the axis OZ and detecting the lateral forces $F_3$.

As can be seen in FIG. 16, the two gauges 101 and 102 are placed in series in the two opposite sides of a measuring bridge, in the two other sides of which two resistances R are connected. The same is true for the other pairs of gauges 201, 202 and 301, 302, all the measuring bridges constituted in this way being connected to the supply circuit 91.

If one wishes to detect the moments and forces at the same time, one naturally uses the two arrangements described in combination on the same test member 1.

What is claimed is:

1. A safety binding for a ski with an electrical circuit, comprising, a stress detection circuit for detecting stress during skiing, said circuit being adapted to produce signals for controlling release of said binding in accordance with detected stress, wherein: said detection circuit being located on one test member for simultaneously detecting stresses in at least two directions, said test member being positioned between the boot and the ski for supporting said boot, said detection circuit being further defined by, at least two groups of four gauges each constituting an individual bridge for detecting stresses exerted in a predetermined direction, these two groups being chosen from the three following groups whose four gauges are symmetrical in pairs with respect to the longitudinal and vertical plane and with respect to the transverse and vertical plane, namely a first group of four gauges arranged in pairs in the lateral vertical faces of the test member and inclined with respect to the transverse and vertical plane, a second group of four gauges arranged in pairs in the lateral vertical faces of the test member and extending parallel to the vertical axis, and a third group of four gauges arranged in pairs in the front vertical faces of the test member and extending parallel to the vertical axis.

2. A safety binding for a ski with an electrical circuit, comprising, a stress detection circuit for detecting stress during skiing, said circuit being adapted to produce signals for controlling release of said binding in accordance with detected stress, wherein: said detection circuit being located on one test member for simultaneously detecting stresses in at least two directions, said test member being positioned between the boot and the ski for supporting said boot, said detection circuit being further defined by said detection circuit further comprising, at least two groups of two gauges each connected in the two opposed sides of a detection bridge in the two other sides of which two resistances of the same constant value are connected, these individual detection bridges detecting stresses exerted in a predetermined direction, these two groups being chosen from the three following groups of gauges, defined by, a first group of two gauges arranged respectively on the lateral vertical faces of the test member, parallel to the vertical axis and symmetrical with respect to the vertical longitudinal plane, and a second group of two gauges arranged on the upper horizontal side of the test member extending parallel to the longitudinal horizontal axis and symmetrical with respect to the longitudinal vertical plane, and a third group of two gauges on the horizontal upper side of the test member extending parallel to the transverse horizontal axis and symmetrical with respect to the transverse vertical plane.

3. A safety binding for a ski with an electrical circuit, comprising a stress detection circuit for detecting stress during skiing, said circuit being adapted to produce signals for controlling release of said binding in accordance with detected stress, wherein: said detection circuit being located on one test member for simultaneously detecting stresses in at least two directions said test member being positioned between the boot and the ski for supporting said boot, the test member is constituted by two parts in the shape of segments of a ring arranged symmetrically with respect to the transverse vertical plane.

4. A safety binding for a ski with an electrical circuit, comprising a stress detection circuit for detecting stress during skiing, said circuit being adapted to produce signals for controlling release of said binding in accordance with detected stress, wherein: said detection circuit being located on a test member for simultaneously detecting stresses in at least two directions, said test member being positioned between the boot and the ski for supporting said boot, the test member being arranged between two plates, namely an upper plate on which the ski boot is retained and a lower plate provided with shock absorber blocks inserted in the plate and having screws passing therethrough to fix said lower plate to the ski.

* * * * *